US009863157B2

(12) United States Patent
Mack

(10) Patent No.: US 9,863,157 B2
(45) Date of Patent: Jan. 9, 2018

(54) TILE TEMPLATE

(71) Applicant: Terry Mack, Bethany, OK (US)

(72) Inventor: Terry Mack, Bethany, OK (US)

( * ) Notice: Subject to any disclaimer, the term of this patent is extended or adjusted under 35 U.S.C. 154(b) by 170 days.

(21) Appl. No.: 14/757,306

(22) Filed: Dec. 15, 2015

(65) Prior Publication Data

US 2017/0167146 A1 Jun. 15, 2017

Related U.S. Application Data

(60) Provisional application No. 62/124,951, filed on Jan. 8, 2015.

(51) Int. Cl.
*E04F 21/00* (2006.01)
*E04F 15/08* (2006.01)

(52) U.S. Cl.
CPC ..... *E04F 21/0076* (2013.01); *E04F 15/08* (2013.01)

(58) Field of Classification Search
CPC ..... E04F 21/00; E04F 21/0076; E04F 21/20; E04F 21/22; G01B 3/14
USPC ..... 33/1 B, 526, 527, 562, 563, DIG. 20
See application file for complete search history.

(56) References Cited

U.S. PATENT DOCUMENTS 2,795,854 A * 6/1957 Perkal ..... B25H 7/00 33/527
5,922,157 A 7/1999 Snider
6,101,730 A 8/2000 Marino
6,115,926 A * 9/2000 Robell ..... E04C 2/043 33/1 B
6,195,904 B1 3/2001 Greer
6,618,955 B2 * 9/2003 Rice ..... A47G 1/205 33/1 B
6,729,035 B1 5/2004 Carrillo
6,834,438 B1 12/2004 Heister
7,028,412 B2 4/2006 Boomershine
7,409,773 B1 8/2008 Giola
7,467,476 B2 * 12/2008 Digavero et al. ..... B25H 7/02 33/528
8,312,634 B1 * 11/2012 Forsyth ..... B25H 7/02 33/1 B
8,739,422 B2 * 6/2014 Gomez ..... G09B 29/00 33/1 G
9,303,415 B1 * 4/2016 Cipriano ..... E04F 21/0076
2013/0061483 A1 3/2013 Wynn
2015/0191920 A1 * 7/2015 Rastegar et al. ..... E04F 21/22 33/527

FOREIGN PATENT DOCUMENTS

DE 2816769 A1 * 10/1979 ..... D03D 1/00

* cited by examiner

*Primary Examiner* — R. A. Smith
(74) *Attorney, Agent, or Firm* — Randal D. Homburg

(57) ABSTRACT

A reusable tile template for self installation of tile on a horizontal or vertical surface, each template being supplied in the same dimension as the large tile being laid, each tile template having an erasable marking surface and made of a bendable material, preferably a recyclable cardboard stock, the tile template being located over the spot where a complex cut tile is to be placed. A mark of fold is applied to the template of the proper size and shape of the next laid tile after which the template dimensions are transferred to the tile to be cut for installation. The tile template is subsequently restored to its flat origin and reused for the next tile as a template until the entire tile installation is complete.

4 Claims, 4 Drawing Sheets

TILE TEMPLATE

CROSS REFERENCE TO RELATED APPLICATIONS

Applicant claims the benefit of U.S. Provisional Patent No. 62/124,951, filed by the same inventor on Jan. 8, 2015.

I. BACKGROUND OF INVENTION

1. Field of the Invention

A reusable tile template for self installation of tile on a horizontal or vertical surface, each template being supplied in the same dimension as the large tile being laid, each tile template having an erasable marking surface and made of a bendable material, preferably a recyclable flexible rubber, the tile template being located over the spot where a complex cut tile is to be placed. A mark or fold is applied to the template of the proper size and shape of the next laid tile after which the template dimensions are transferred to the tile to be cut for installation. The tile template is subsequently restored to its flat origin and reused for the next tile as a template until the entire tile installation is complete.

2. Description of Prior Art

A preliminary review of prior art patents was conducted by the applicant which reveal prior art patents in a similar field or having similar use. However, the prior art inventions do not disclose the same or similar elements as the present tile template, nor do they present the material components in a manner contemplated or anticipated in the prior art.

The most relative patent found was U.S. Pat. No. 5,922,157 to Snider, which is disclosed as a sheet of paper that is folded and marked for single use on a single tile to be cut. It is not reusable and is intended to adhere to the tile using a portion of the tile adhesive picked up when overlaid in the space where the tile is going. It is supplied in tear off sheets. The remaining prior art patents do not contemplate the or serve as a basis to sustain any obviousness basis for rejection.

The present tile template is intended form multiple tile use, by using ink or an erasable marker to mark the size and shape of the next laid tile on a wall or floor, with the tile template presenting a copy of the tile configuration with cutouts and cutoff portions, providing a light-weight example of the next laid tile prior to cutting the next laid tile. The template is preferably a rubber product with flexibility for bending, but should have no weft side to side of warp, front to back. A preferable embodiment would be a recycled rubber with webbing inlaid to prevent the weft stretch, ensuring that the tile template is not deformed so that mis-marking can occur.

II. SUMMARY OF THE INVENTION

A template having the size and shape of a tile which may be folded, marked and perforated to the contour of a tile requiring cutting, shaping or perforation prior to being installed, the template preferably being made of a disposable product, but durable enough to withstand repeated use during an entire tile job, being unfolded with marks capable of erasure for use on other tiles during a project. Cardboard stock would be preferable with a markable and erasable surface. The template, once folded and or marked, can be overlaid in the space to ensure proper fit prior to cutting the tile, including cutout portions which may be required to fit around plumbing, electrical or outlet devices involved in the area being tiled.

III. DESCRIPTION OF THE DRAWINGS

The following drawings are informal drawings submitted with this provisional patent application.

Figure 4:
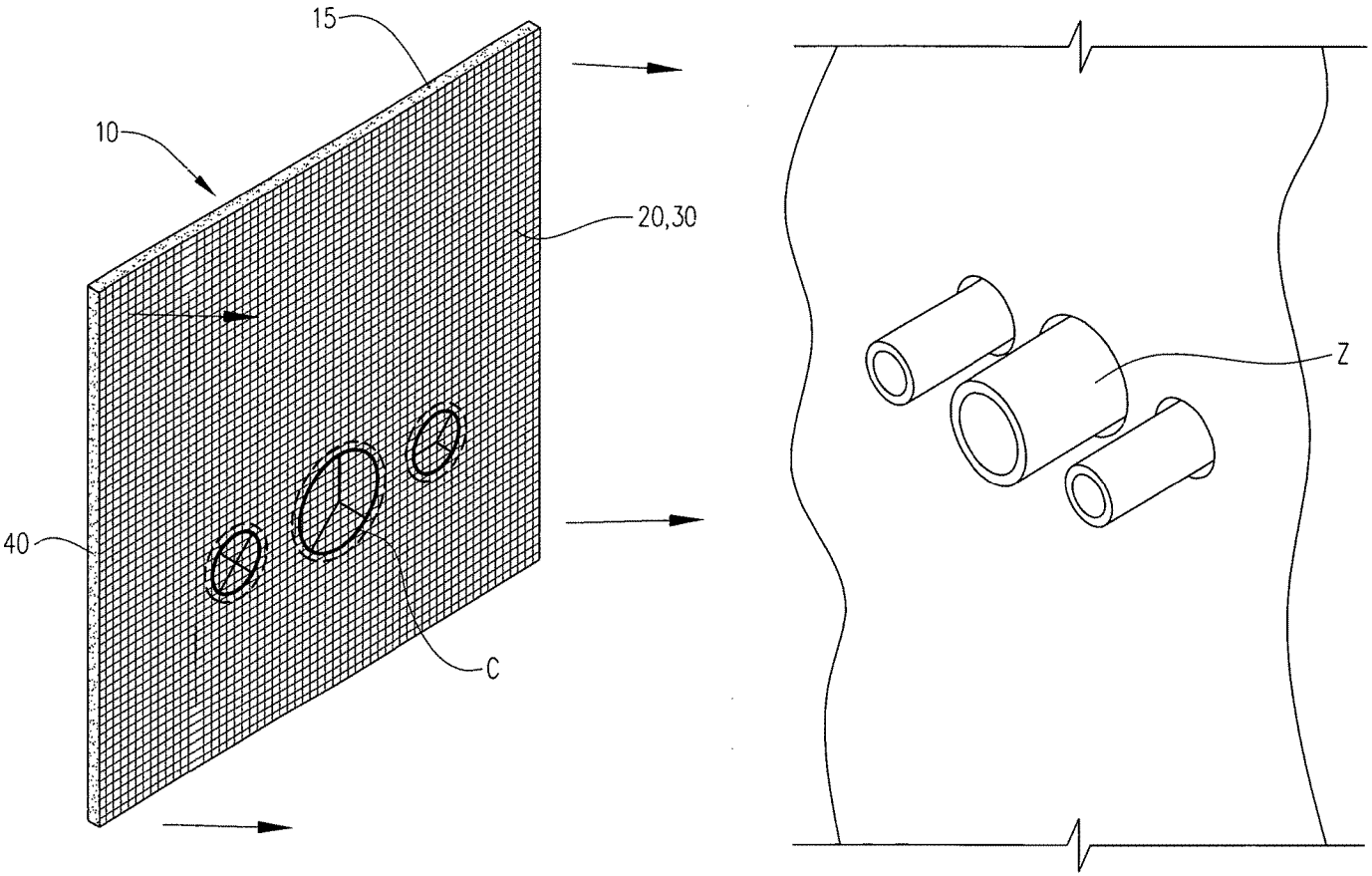

FIG. 4 a tile template for placement on a shower and tub wall with circular cut-out sections indicating holes in the template corresponding to those required to be cut in a transfer tile section for the plumbing line of a bathtub nozzle and hot and cold water valves to be inserted upon placement of a cut tile section.

IV. DESCRIPTION OF THE PREFERRED EMBODIMENT

A tile template 10 for marking and pre-fitting a complex cut on a tile 100 during a tile laying job on a vertical or horizontal surface, as demonstrated in FIGS. 1-4 of the drawings, the tile template of a shaped flat material defining an upper marking surface 20 and lower marking surface 30, the template 10 providing a precise and identical dimension as the tiles 100 being laid, each marking surface 20, 30, being non-stick and allowing for use of an erasable marker to mark straight lines A, diagonal lines B, irregular cut portions, or cutout portions C which would be encountered during a tile job when a full tile is not suited. The tile template 10 is made of a flexible material 15 which can be bent, but it will not stretch so that it will maintain its shape and integrity when held in place and marked, the tile template 10 preferably made from a neoprene, rubber or flexible plastic which can be cut, folded, marked and fitted for a next laid tile 10 in a tile laying job, FIG. 3. The neoprene, rubber or plastic are generally inlayed or layered over a web matrix 40, which prevents weft or warp stretching. Weft is defined as the fabric capacity to stretch across the template, or side-to-side, and warp is the fabric capacity to stretch along the template, or top-to-bottom.

Figure 1:
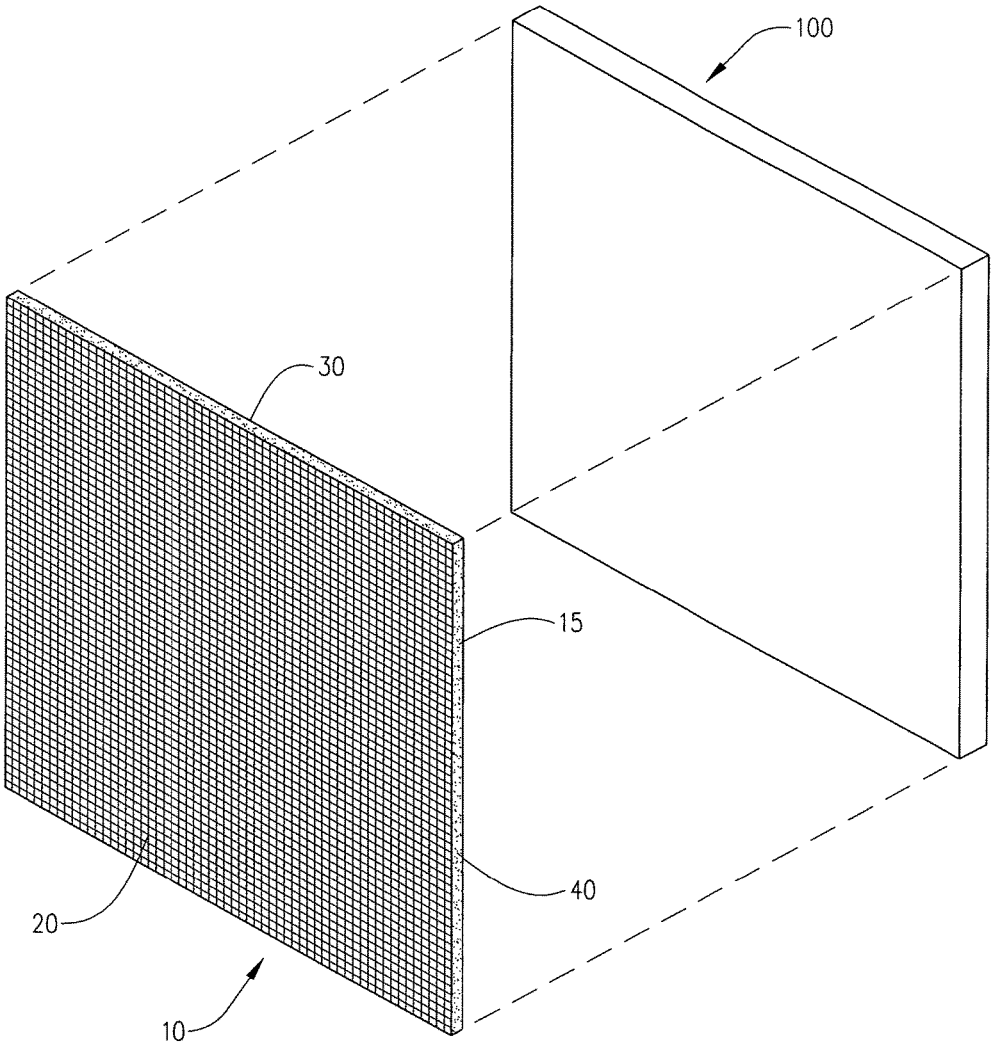
FIG. 1 is a perspective view of the tile template over a section of tile.
Figure 2:
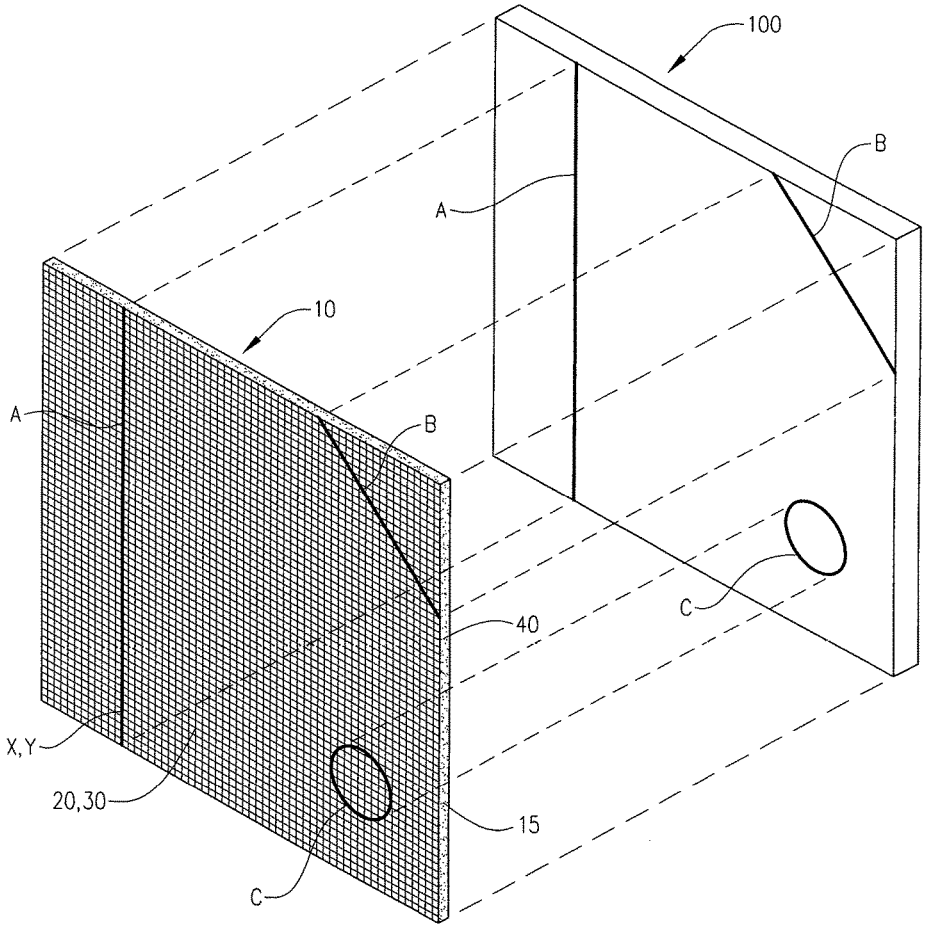
FIG. 2 is a perspective view of a marked tile template with the lines indicating the transfer of cut lines for the below tile section.
Figure 3:
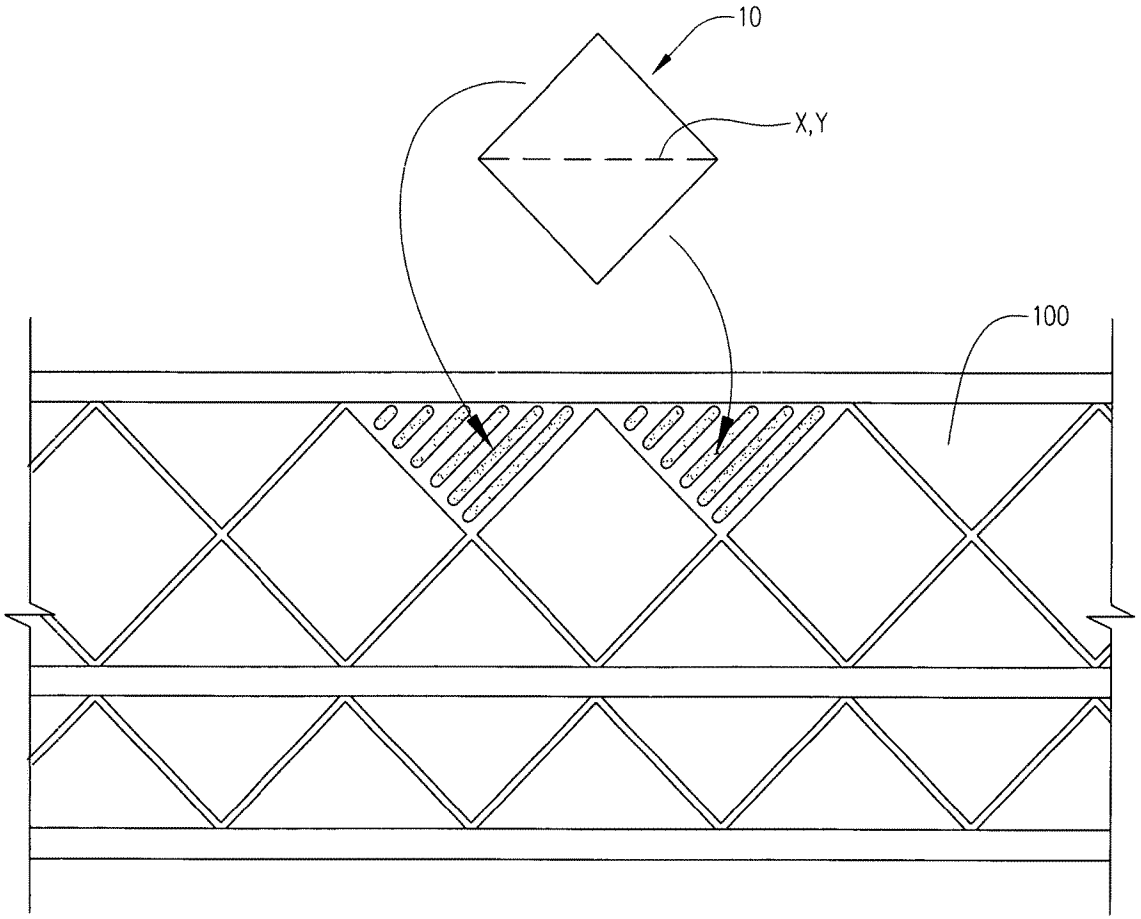
FIG. 3 is a representation of a wall with several set tile section and two openings for tiles to be cut for placement and completion of the wall tile pieces to be cut for installation.

Once cut, marked folded and fitted for the next tile location, the template 10 is placed over a tile 100, the tile 100 then being marked and cut for placement, FIG. 2. The template 10 eliminates guess work, measurement or having to hold the tile 100 over the location, tile 100 often having significant weight on larger dimension tiles. It is contemplated that the tile templates 10 are best suited for larger dimension tile and not the smaller tile and also suited for sheets of tile materials having an array of tiles attached to a backing matrix which generally have a tendency to sag or deform when held on a vertical surface, FIG. 3.

The marking surfaces 20, 30, are intended to resist retention of an adhesive and allow for a mark to be erased after use when using a non-permanent marking X, providing the template 10 for repeated use during a tile installation, the template 10 being designed for multiple use by erasing the marks, by releasing the tile template back to a flat embodiment, by reattaching cut portions back into the template, or by simply rotating the template for a subsequent use. By including both flat marking surfaces 20, 30, with the same erasable surface, the user can also simply turn the template 10 over and use the other side, which in some cases allows for the template to be used for the next two tiles 100, FIG. 3. The marking may also be of a permanent nature when using permanent marking Y, since the template is generally discarded after the completion of the tile job.

The template 10 is utilized for design marking, cut side indication or perforation as seen in FIG. 4, diagonal cuts, cutouts for faucet extensions, FIG. 4, plumbing lines Z, electrical or other outlets, special accessories such as soap dishes, accessory bars, drain covers and drain pans, door hinges or other items which may be in the way of a simple tile job. It is also intended for those having less skill than a professional and for those who are performing the tile job by themselves.

Although the embodiments of the template 10 have been described and shown above, it will be appreciated by those skilled in the art that numerous modifications may be made therein without departing from the scope of the invention as herein described.

What is claimed is:

1. A tile template for use it marking and cutting tile on a vertical or horizontal surface, the template comprising:

a shaped flat flexible material defining an upper marking surface, a lower marking surface and having a dimension of the exact shape and size of said tile being installed; and a web matrix incorporated within said flexible material preventing said material from stretching to maintain the shape and integrity when marked and transferred onto said tile to ensure proper marking, said material also providing for perforation for extended objects or cutout portions.

2. The tile template as disclosed in claim 1, further comprising said material is neoprene, rubber or plastic.

3. The tile template as disclosed in claim 1, further comprising said upper marking surface and said lower marking surface are erasable and provide a non-stick surface for erasable marking tools.

4. The tile template as disclosed in claim 1 wherein said material can be folded, cut or perforated to accommodate placement of faucet extensions, plumbing lines, outlets, or other accessories which do not encroach upon an edge of said tile.

* * * * *